US012320010B2

(12) United States Patent
Sato et al.

(10) Patent No.: US 12,320,010 B2
(45) Date of Patent: Jun. 3, 2025

(54) ALLOY MEMBER AND METHOD FOR HARDENING SURFACE THEREOF

(71) Applicant: CASIO COMPUTER CO., LTD., Tokyo (JP)

(72) Inventors: Junichi Sato, Hino (JP); Kazuma Kobayashi, Fuchu (JP); Shouta Nagasawa, Machida (JP); Kenichi Inoue, Hamura (JP); Chinfu Liu, Guangdong (CN); Wuchien Liu, Guangdong (CN); Tienchai Lin, Kaohsiung (TW); Weipin Kao, Kaohsiung (TW)

(73) Assignee: CASIO COMPUTER CO., LTD., Tokyo (JP)

( * ) Notice: Subject to any disclaimer, the term of this patent is extended or adjusted under 35 U.S.C. 154(b) by 137 days.

(21) Appl. No.: 18/097,536

(22) Filed: Jan. 17, 2023

(65) Prior Publication Data

US 2023/0167533 A1 Jun. 1, 2023

Related U.S. Application Data

(60) Division of application No. 16/457,938, filed on Jun. 29, 2019, now Pat. No. 11,578,399, which is a (Continued)

(30) Foreign Application Priority Data

Jan. 3, 2017 (CN) ..... 201710000671.1
Dec. 7, 2017 (CN) ..... 201711284040.3

(51) Int. Cl.
*C23C 8/10* (2006.01)
*C22F 1/02* (2006.01)
(Continued)

(52) U.S. Cl.
CPC ..... *C23C 8/10* (2013.01); *C22F 1/02* (2013.01); *C22F 1/183* (2013.01); *C22C 14/00* (2013.01)

(58) Field of Classification Search
CPC ... C23C 8/10; C22F 1/02; C22F 1/183; C22C 14/00
See application file for complete search history.

(56) References Cited

U.S. PATENT DOCUMENTS 5,178,694 A 1/1993 Wu et al.
6,221,173 B1 4/2001 Shibuya et al.
(Continued)

FOREIGN PATENT DOCUMENTS

CN 1214086 A 4/1999
CN 1380856 A 11/2002
(Continued)

OTHER PUBLICATIONS

Chinese Office Action (and English language translation thereof) dated Feb. 7, 2021 issued in Chinese Application No. 201711284040.3.

(Continued)

*Primary Examiner* — Anthony M Liang
(74) *Attorney, Agent, or Firm* — Holtz, Holtz & Volek PC

(57) ABSTRACT

The present disclosure relates to a titanium or titanium alloy member and to a surface hardening method for the titanium or titanium alloy member. The titanium or titanium alloy member includes a base material of titanium or titanium alloy, and at a surface of the base material, a hardened layer formed by diffusion of oxygen into the surface.

9 Claims, 7 Drawing Sheets

Related U.S. Application Data continuation-in-part of application No. PCT/JP2017/047224, filed on Dec. 28, 2017.

(51) Int. Cl.
*C22F 1/18* (2006.01)
*C22C 14/00* (2006.01)

(56) References Cited

U.S. PATENT DOCUMENTS

| | | | |
|---|---|---|---|
| 6,855,215 | B2 | 2/2005 | Kushida et al. |
| 2005/0194075 | A1 | 9/2005 | Iwai et al. |

FOREIGN PATENT DOCUMENTS

| | | | |
|---|---|---|---|
| CN | 1664160 | A | 9/2005 |
| CN | 103348029 | A | 10/2013 |
| CN | 111690925 | A | 9/2020 |
| JP | H03090555 | A | 4/1991 |
| JP | 2000144356 | A | 5/2000 |
| JP | 2000220967 | A | 8/2000 |
| JP | 2005248256 | A | 9/2005 |
| JP | 2008013833 | A | 1/2008 |

OTHER PUBLICATIONS

International Search Report (ISR) dated Feb. 20, 2018 issued in International Application No. PCT/JP2017/047224.

Japanese Office Action (and English language translation thereof) dated Jun. 23, 2020 issued in counterpart Japanese Application No. 2018-560394.

Johnson, Heat Treating: Furnace Atmospheres, 1994, ASM Handbook vol. 4, p. 542-567 (Year: 1990).

Office Action (Non-Final Rejection) dated Sep. 3, 2021, issued in parent U.S. Appl. No. 16/457,938.

Written Opinion dated Feb. 20, 2018 issued in International Application No. PCT/JP2017/047224.

Chuang, et al., "Microstructure and Properties of Vacuum Pulse Oxygen Permeation Hardening Layer on TC4 Titanium Alloy", Surface Techlogy, vol. 42, No. 3, p. 38-41.

ALLOY MEMBER AND METHOD FOR HARDENING SURFACE THEREOF

CROSS REFERENCE TO RELATED APPLICATIONS

This application is a Divisional Application of U.S. application Ser. No. 16/457,938, filed Jun. 29, 2019, which is a Continuation in Part application of PCT Application No. PCT/JP2017/047224, filed Dec. 28, 2017. PCT Application No. PCT/JP2017/047224 is based upon and claims benefit of priority from Chinese Patent Application No. 201710000671.1, filed Jan. 3, 2017, and Chinese Patent Application No. 201711284040.3, filed Dec. 7, 2017. The entire contents of all the above-identified applications are incorporated herein by reference.

TECHNICAL FIELD

The present disclosure relates to an alloy member and a surface hardening method thereof.

BACKGROUND ART

Titanium or titanium alloys (referred to below as "titanium material") are used in ornamental items such as a luxury wristwatch, an accessory, a glasses frame, or the like. However, when the surface hardness of the titanium material is low, the ornamental item is easily scratched, and when the ornamental item is used over a long period, luster declines, and external appearance quality deteriorates. Thus, the surface of the titanium material may undergo hardening treatment in order to increase the surface hardness of the titanium material and to retain the luster and external appearance quality.

According to the atmospheric thermal oxidation processing method that is a conventional surface hardening method, the finished oxide layer is gray colored, the metallic luster is lost, the surface is rough, and processing is required later for use in an ornamental item. Alternatively, when using a method that further performs vacuum diffusion processing after atmospheric thermal oxidation processing, crystal grain size becomes course, surface luster declines, and polishing treatment is difficult. Although crystalline grain size and surface roughness are improved by using a vacuum thermal oxidation nitrification diffusion processing method, when the proportion of nitrogen, oxygen, or steam or the temperature of thermal processing cannot be skillfully adjusted, the surface of the titanium member becomes discolored and rough.

Patent Literature 1 and Patent Literature 2 mention the aforementioned vacuum thermal oxidation nitrification diffusion processing method, which despite a solid solution of nitrogen and oxygen improving the surface hardness of the material, due to the high hardness value obtained by the nitrogen solid solution, adhesion of a vapor-deposited film deposited thereafter becomes relatively low, or the introduction of nitrogen discolors the surface of the titanium material, tends to make the surface rough, and lowers the external appearance quality of the titanium material.

CITATION LIST

Patent Literature

Patent Literature 1: Chinese Patent Application Publication No. 1214086

Patent Literature 2: Chinese Patent Application Publication No. 1380856

SUMMARY

In consideration of the aforementioned circumstances, an object of the present disclosure is to provide an alloy member and a surface hardening method capable of maintaining high surface hardness, high luster, and good external appearance.

An alloy member according to a first aspect of the present disclosure includes a base material of titanium or titanium alloy; and at a surface of the base material, a hardened layer formed by diffusion of oxygen into the surface.

An alloy member according to a second aspect of the present disclosure includes a base material of titanium or titanium alloy; and at a surface of the base material, a hardened layer formed by diffusion of nitrogen and oxygen into the surface.

The hardened layer preferably includes a surface transparent oxide layer, and a diffusion layer disposed internally from the surface transparent oxide layer.

The diffusion layer is preferably thicker than the surface transparent oxide layer.

Preferably, the hardened layer includes, in order inwardly from the surface of the base material, a surface transparent oxide layer, an external diffusion layer, and an internal diffusion layer; the external diffusion layer includes a portion having a hardness greater than or equal to 300 Hv, the portion being disposed internally from the surface transparent oxide layer; and the internal diffusion layer includes a portion having a hardness less than 300 Hv.

The surface transparent oxide layer is preferably thinner than the external diffusion layer and the internal diffusion layer.

Preferably, a concentration of oxygen dissolved in solid solution in the external diffusion layer is higher than that in the internal diffusion layer, and the concentration of oxygen dissolved in solid solution in the internal diffusion layer gradually decreases from outside towards inside.

Preferably, concentrations of oxygen and nitrogen dissolved in solid solution in the external diffusion layer are preferably higher than those in the internal diffusion layer, and the concentrations of oxygen and nitrogen dissolved in solid solution in the internal diffusion layer preferably gradually decrease from outside towards inside.

The titanium or titanium alloy member is preferably applicable to a casing component of a wristwatch or a clock.

The casing component preferably includes a bezel, a bezel center region, a back cover, or a band.

Moreover, a surface hardening method of a titanium or titanium alloy member according to a third aspect of the present disclosure includes: a heating step of heating a titanium or titanium alloy base material of the member to a predetermined temperature under an inert gas atmosphere; a hardening step of introducing (i) a mixed gas including an inert gas, and (ii) a hardening treatment gas including oxygen gas, at the predetermined temperature, to perform hardening treatment of a surface of the base material; and a cooling step of cooling the base material down to room temperature under the inert gas atmosphere.

In the hardening step, the hardening treatment gas preferably further includes nitrogen gas.

In the hardening step, preferably, after passage of a predetermined period after the introducing of the mixed gas, the hardening treatment gas is introduced to perform the hardening treatment.

In the hardening step, preferably, simultaneous with the introducing of the mixed gas, the hardening treatment gas is introduced to perform the hardening treatment.

In the hardening step, the introducing and a stoppage of the introducing of the hardening treatment gas are preferably repeatedly performed.

In the hardening step, the mixed gas preferably includes the inert gas and hydrogen gas.

the method preferably further includes a hydrogen removing step of introducing, after the hardening step, the inert gas to remove hydrogen.

The hydrogen removing step is preferably performed at a temperature higher than the hardening step.

DESCRIPTION OF EMBODIMENTS

Embodiments of the present disclosure are described in detail with reference to the drawings. In the appended drawings, identical reference symbols are assigned to identical or equivalent component parts, and repeated description of such component parts is omitted. Further, the embodiments below are merely suitable embodiments of the titanium or titanium alloy member and the surface hardening method thereof of the present disclosure, and the present disclosure is not limited to the below-listed embodiments.

Embodiment 1

Figure 1:
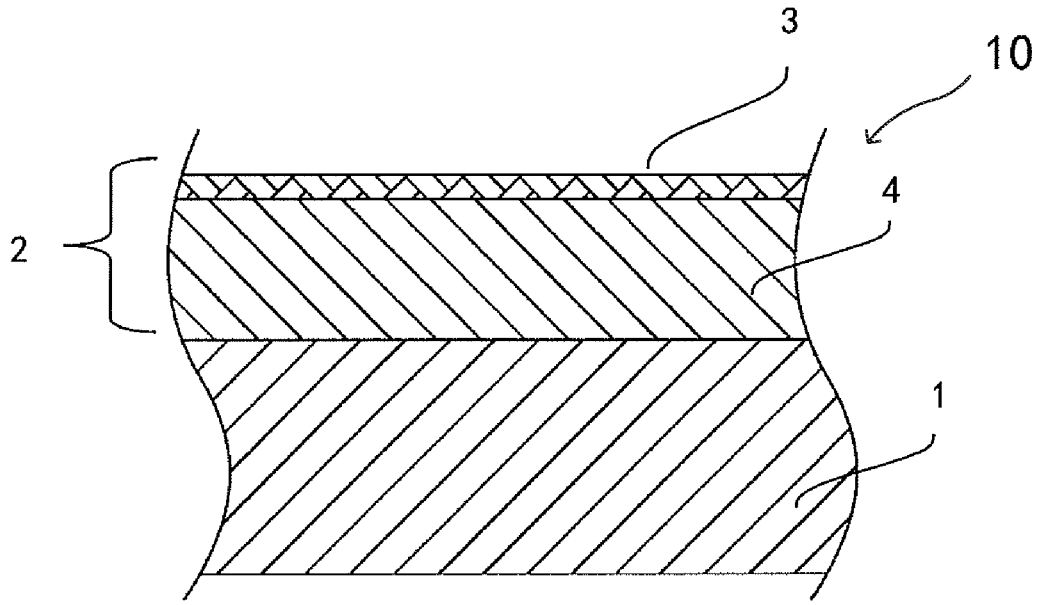
FIG. 1 is a schematic drawing of structure of a titanium or titanium alloy member according to Embodiment 1 of the present disclosure.

FIG. 1 is a schematic drawing of structure of a titanium or titanium alloy member according to Embodiment 1 of the present disclosure. A pure titanium or titanium alloy member 10 illustrated in FIG. 1 is provided with a base material 1 formed from pure titanium or titanium alloy and has a hardened layer 2 formed by diffusing oxygen into a surface of the base material 1, and the hardened layer 2 includes a surface transparent oxide layer 3 and a diffusion layer 4.

The hardened layer 2 protects the base material 1, improves surface hardness of the base material 1, and provides long-term maintenance of luster and good external appearance.

The surface transparent oxide layer 3 is thinner than the diffusion layer 4. Due to the thin surface transparent oxide layer 3, discoloration due to light interference is suppressed.

Titanium and oxygen have high mutual affinity, and therefore the transparent oxide layer 3 is easily formed on the surface of the titanium, and the transparent oxide layer 3 prevents further reaction between titanium and exterior oxygen. However, thickness of the transparent oxide layer 3 greatly affects the external appearance of the surface of the base material 1. When the transparent oxide layer 3 is excessively thick, visible light interference phenomena occur, and color of the surface changes with changes in thickness of the layer. Experiments revealed that the surface of the base material 1 had a metallic luster when film thickness of the transparent oxide layer 3 was less than 10 nm, the surface of the base material 1 became gold colored when the film thickness of the transparent oxide layer 3 was 10 to 25 nm, the surface of the base material 1 became blue colored when the film thickness of the transparent oxide layer 3 was 25 to 70 nm, and the surface of the base material 1 became bluish-purple when the film thickness of the transparent oxide layer 3 was 70 to 150 nm.

Good metallic luster is obtained by the present embodiment, and thickness of the surface transparent oxide layer 3 is kept at less than or equal to 10 nm in order to maintain high luster.

Moreover, the diffusion layer 4 is a solid solution formed by diffusion of oxygen into the base material 1.

In accordance with mutual interactivity occurring between titanium and added elements, the phase conversion temperature of titanium changes. Elements that cause a rise in the $\beta/\alpha$ phase conversion temperature are termed "$\alpha$ phase stabilizer elements" of titanium. Oxygen is an $\alpha$ phase stabilizer element of titanium and has high solid solubility in the titanium base material. By dissolved in solid solution in titanium, oxygen greatly increases the $\alpha/\beta$ phase conversion temperature of titanium, and hardness of the titanium remarkably increases.

In the present embodiment, the diffusion layer 4 formed by the solid solution by diffusion of oxygen mainly includes the hardened layer 2, and improves surface hardness of the pure titanium or titanium alloy member 10. The thicker the diffusion layer 4, the higher the content of oxygen dissolved in solid solution, and the higher the surface hardness of the pure titanium or titanium alloy member 10.

Figure 2:
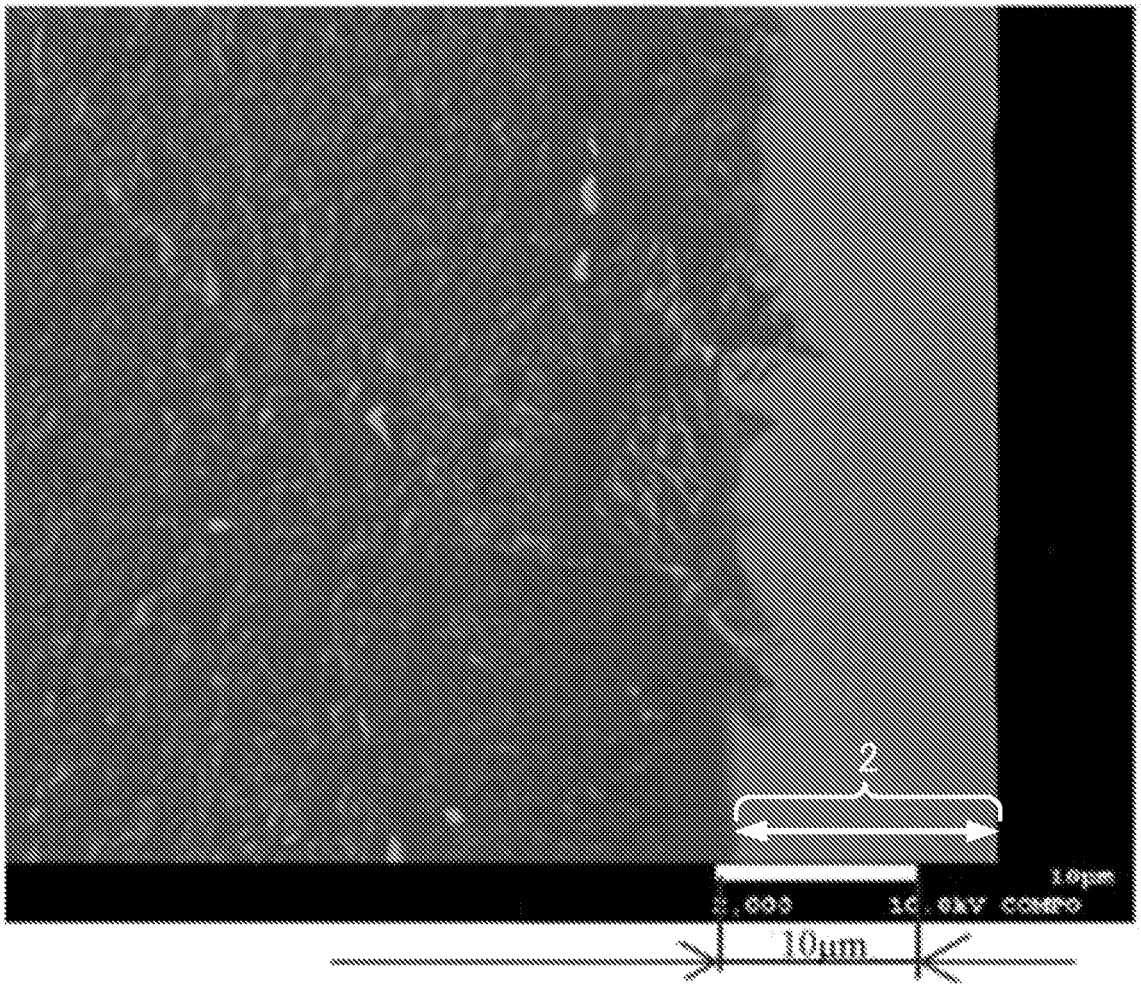
FIG. 2 is an image illustrating results of scanning electron microscope (SEM) measurement of a cross section of the titanium or titanium alloy member according to Embodiment 1 of the present disclosure.

FIG. 2 illustrates results of measurement of a cross section of the pure titanium or titanium alloy member 10 according to Embodiment 1 of the present disclosure by scanning electron microscope (SEM).

As illustrated in FIG. 2, a portion of the hardened layer 2 having a thickness greater than or equal to about 10 μm was observed in the surface of the base material 1.

In the aforementioned manner, the surface transparent oxide layer 3 having a thickness less than or equal to 10 nm was formed on the surface of the hardened layer 2. The diffusion layer 4 was far thicker than the surface transparent oxide layer 3, and thus thickness of the diffusion layer 4 was nearly the same as thickness of the hardened layer 2.

Figure 3:
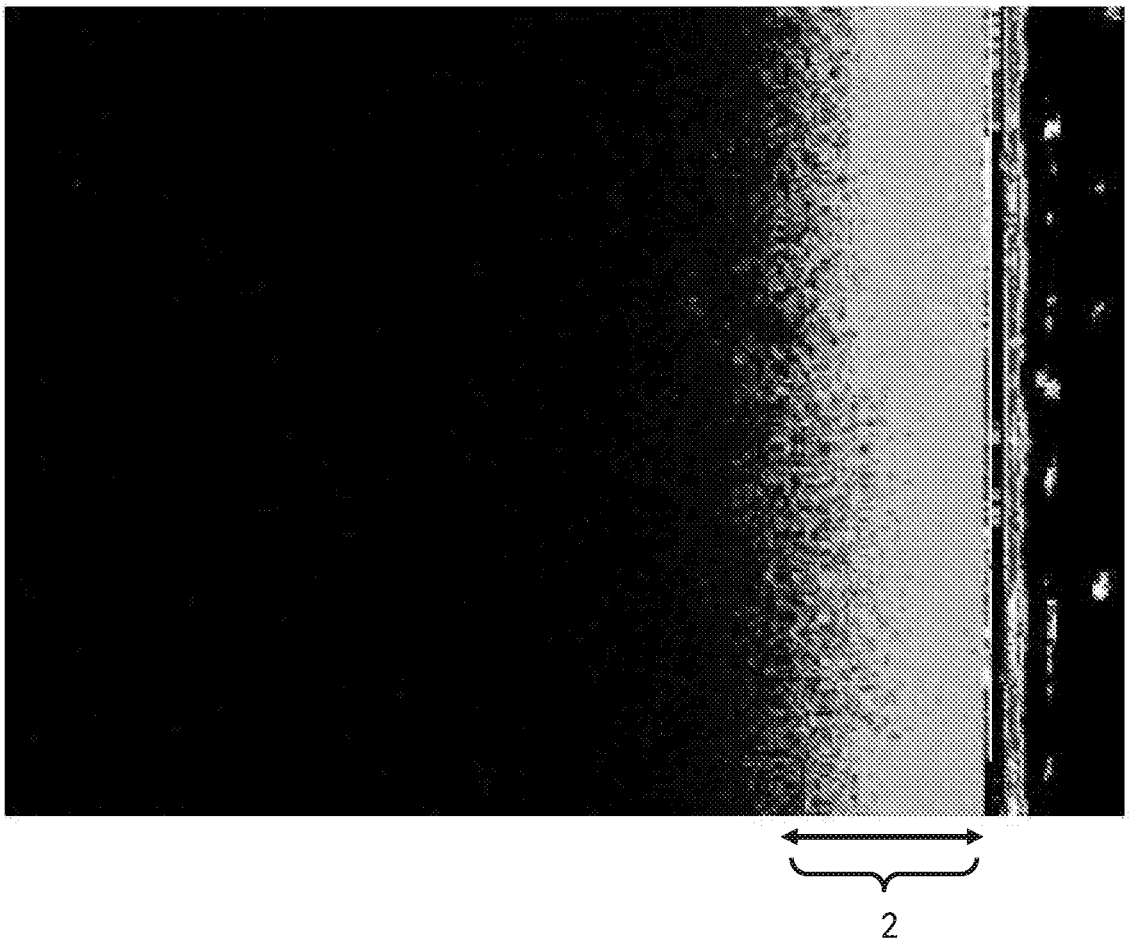
FIG. 3 is an image illustrating results of measurement of oxygen by electron probe micro-analysis (FB-EPMA-WDS) of the cross section of the titanium or titanium alloy member according to Embodiment 1 of the present disclosure.

FIG. 3 illustrates results of measurement of oxygen by electron probe micro-analysis (FE-EPMA-WDS) in the cross section of the pure titanium or titanium alloy member 10 according to Embodiment 1 of the present disclosure.

As illustrated in FIG. 3, oxygen concentration was high in the portion of the hardened layer 2 of the surface of the base material 1. This indicates that a high concentration of oxygen was included in the surface transparent oxide layer 3 and the diffusion layer 4 included in the hardened layer 2.

Table 1 shows one example of a relationship between hardness and depth in the hardened layer 2 of the pure titanium or titanium alloy member 10 in the present embodiment.

Further the hardness of the hardened layer 2 of the pure titanium or titanium alloy member 10 was measured as described below.

Sample: after DCL treatment, test plate of pure titanium or titanium alloy member 10 of the present embodiment Hardness measurement method: nano-indenter Measurement load: 0.5 gf Hardness measurement locations: 20 measurement locations having 5 μm surface separation from the embedding resin and cross section A correlation was obtained between Vickers hardness and nano-indenter hardness at a central portion of the sample, and conversion was made to Vickers hardness.

TABLE 1

Example of Relationship between Hardness and Depth of Hardened Layer 2 of Pure Titanium or Titanium Alloy Member 10 in Embodiment 1

| Depth from surface (μm) | Hardness (Hv) |
|---|---|
| 0 | 592.0 |
| 5 | 508.7 |
| 10 | 391.8 |
| 15 | 299.9 |
| 20 | 226.1 |
| 25 | 209.6 |
| 30 | 188.4 |
| 35 | 192.4 |
| 40 | 184.5 |
| 45 | 197.1 |
| 50 | 189.2 |
| 55 | 189.2 |
| 60 | 186.1 |
| 65 | 191.6 |

As illustrated in Table 1, the surface of the pure titanium or titanium alloy member 10 has a hardness that is sufficiently high for actual use and reaches a maximum value of hardness of about 600 Hv. With increased depth in the interior of the pure titanium or titanium alloy member 10, hardness decreases, and at extremely deep locations, the hardness of the pure titanium or titanium alloy member 10 decreases down to the same hardness as that of the base material 1.

In the present embodiment, the hardened layer 2 is defined to be the portion, below the surface of the base material 1, that has a hardness greater than or equal to 200 Hv. As illustrated in Table 1, the hardened layer 2 in the present embodiment was the portion of about 25 μm or less depth from the surface of the base material 1, and this portion had high hardness.

Figure 4:
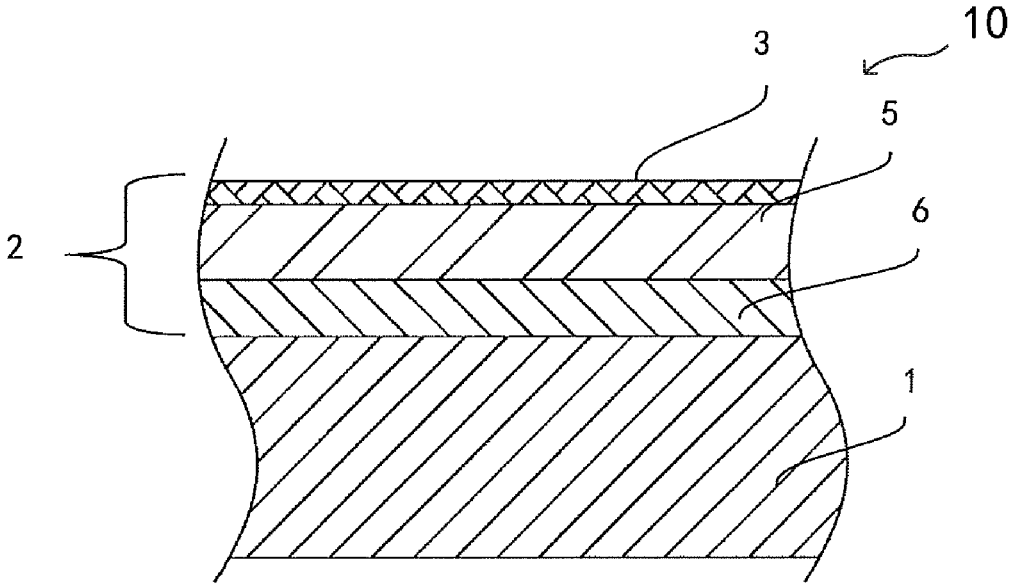
FIG. 4 is a schematic drawing of another structure of the titanium or titanium alloy member according to Embodiment 1 of the present disclosure.

FIG. 4 is a schematic drawing of another structure of the titanium or titanium alloy member according to Embodiment 1 of the present disclosure.

As illustrated in FIG. 4, the pure titanium or titanium alloy member 10 includes the base material 1 formed from pure titanium or titanium alloy, and the hardened layer 2 formed in the surface of the base material 1; and the hardened layer 2 includes the surface transparent oxide layer 3, an external diffusion layer 5, and an internal diffusion layer 6.

In the present embodiment, the external diffusion layer 5 includes, on an inner side of the surface transparent oxide layer 3, a portion having a hardness greater than or equal to 300 Hv, and the internal diffusion layer 6 includes a portion having a hardness less than or equal to 300 Hv.

That is to say, the hardened layer 2 of the pure titanium or titanium alloy member 10 illustrated in FIG. 4 includes two diffusion layers that are the external diffusion layer 5 and the internal diffusion layer 6. The surface transparent oxide layer 3 is thinner than the external diffusion layer 5 and the internal diffusion layer 6.

In the external diffusion layer 5, concentration of oxygen dissolve in solid solution is high, and thickness of the external diffusion layer 5 greatly affects the surface hardness of the base material 1. According to Table 1, the external diffusion layer 5 was the portion down to a depth of about 15 μm in the base material 1 from the inward side of the surface transparent oxide layer 3.

In the internal diffusion layer 6, the concentration of oxygen dissolved in solid solution gradually decreased from outside towards inside, and the hardness also gradually decreased from 300 Hv down to a value that is the same as that of the base material 1 of the pure titanium or titanium alloy member 10. According to Table 1, the internal diffusion layer 6 was the portion, from the inner side of the external diffusion layer 5, up to about 25 μm depth from the surface.

In the aforementioned manner, the pure titanium or titanium alloy member 10 of the present embodiment has sufficient surface hardness due to formation of the hardened layer 2.

Moreover, the pure titanium or titanium alloy member 10 of the present embodiment has a surface that is uniformly white, is free of color mottling, and is not discolored. As a result of using a spectrophotometer to measure an example of the pure titanium or titanium alloy member 10, the surface gloss color difference, as expressed by the CIE 1976 (L*, a*, b*) E*ab value, was E*ab≤1.0, and color mottling was found to be low. That is, in the present embodiment, surface hardness of the pure titanium or titanium alloy member 10 was high, and metallic luster was high.

Table 2 illustrates a comparison of surface luster of the pure titanium or titanium alloy member 10 before and after formation of the hardened layer 2 on the surface of the pure titanium or titanium alloy member 10 in the present embodiment.

TABLE 2

| Item | Prior to formation of hardened layer 2 (comparative example) | After formation of hardened layer 2 (present embodiment) |
|---|---|---|
| L* value | 79 | 80 |
| a* value | 1 | <1 |
| b* value | 5 | 4 |

In Table 2, the L* value indicates brightness, and the higher the L* value, the higher the brightness. The a* value indicates a reddish color or a greenish color; the larger the a* value is as a positive value, the more reddish the coloration; and the more negative the a* value is as a negative value, the more greenish the coloration. The larger the b* value is as a positive value, the more yellowish the coloration, and the more negative the b* value as a negative value, the more blueish the coloration.

From the data of Table 2, the pure titanium or titanium alloy member 10 of the present embodiment is understood to have surface luster nearly the same as that of metallic titanium, despite the formation of the transparent oxide layer 3 on the surface and the diffusion of oxygen. That is to say, by forming the hardened layer 2, the pure titanium or titanium alloy member 10 of the present embodiment, while having high hardness, maintains high surface luster and maintains good external appearance.

Furthermore, the pure titanium or titanium alloy member 10 of the present embodiment is used as a casing component of a wristwatch or clock. Moreover, the term "casing component" includes components such as a bezel, a bezel center region, a back cover, a band, or the like. Moreover, the pure titanium or titanium alloy member 10 of the present embodiment may be used as a decorative component such as a fastener, a glasses frame, a ring, a bracelet, or the like. Moreover, the pure titanium or titanium alloy member 10 of the present embodiment can be used as a component of base material for which the titanium or titanium alloy member is required, such as a food vessel, golf club, or the like.

Embodiment 2

The present embodiment relates to the surface hardening method of the pure titanium or titanium alloy.

Figure 5:
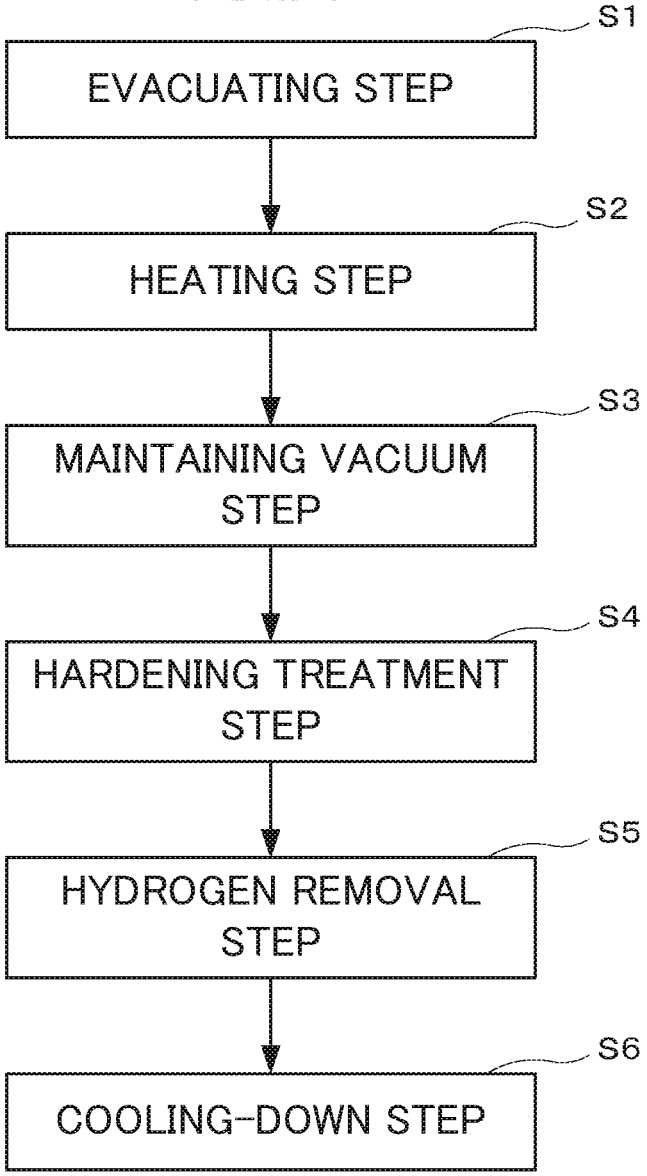
FIG. 5 is a flowchart illustrating a hardening method of a titanium or titanium alloy member according to Embodiment 2 of the present disclosure.

FIG. 5 is a flowchart illustrating the hardening method of the titanium or titanium alloy member according to Embodiment 2 of the present disclosure.

As illustrated in FIG. 5, firstly in step S1, evacuation is performed. Specifically, the cleaned titanium or titanium alloy base material is loaded into an oven, and the oven is evacuated for at least 30 minutes. Here, evacuation is performed until degree of vacuum is less than or equal to $5\times10^{-4}$ Pa. Moreover, the cleaned titanium or titanium alloy base material is base material that, after fabrication, undergoes cleaning processing by ultrasound. Moreover, as may be required, polishing treatment, hairline processing, blast finishing, or the like may be performed to treat the surface of the base material.

Next, in step S2, the titanium or titanium alloy base material is heated to a predetermined temperature while an inert gas is fed to the vacuum oven. In the present embodiment, in order to prevent discoloration due to oxidation of the surface of the base material, the inert gas is continuously fed during the heating. The inert gas, for example, is argon gas or helium gas. During feeding of the inert gas and heating, the degree of vacuum within the vacuum oven is 1 to $5\times10^{-4}$ Pa.

Moreover, the predetermined temperature is 600 to 800° C., and preferably is 650 to 750° C. When the heating temperature exceeds 750° C., grain growth clearly easily occurs on the surface of the pure titanium and titanium alloy, roughness of the base material surface may increase, luster may decline, and external appearance quality of the base material may decline. However, when the heating temperature is less than 650° C., the diffusion rate of gas into the base material may be low, the hardening treatment period may become prolonged, and hardening efficiency may decreases.

Moreover, the temperature range of 650° C. to 750° C. is the recrystallization temperature range of pure titanium or titanium alloy, and such a temperature range acts to resolve internal stresses and crystal grain damage generated by the base material undergoing the steps of molding, cutting, grinding, polishing, or the like.

Next, in step S3, after raising the temperature of the vacuum oven to, and maintaining at, the predetermined temperature, evacuation is further performed for at least 5 or more minutes to increase the degree of vacuum.

Next, in step S4, the predetermined temperature is maintained for a fixed period, a mixed gas containing an inert gas, such as a mixture of argon gas and hydrogen gas, is introduced to the oven, and after a predetermined period, oxygen gas as a hardening treatment gas is fed to perform hardening treatment for at least 60 minutes.

Due to introduction of hydrogen gas in the present embodiment, rapid accumulation of the amount of oxygen gas dissolved in solid solution at the titanium surface is prevented, thickening of the oxide layer of the base material surface is prevented, and diffusivity of oxygen in the base material increases.

In the present embodiment, the oxygen gas may be introduced intermittently. That is to say, after introduction of oxygen gas over a fixed period, the feed of the oxygen gas is stopped, and after passage of a fixed period, the introduction of oxygen gas is resumed. The supply of oxygen is performed intermittently in this manner. The inert gas and hydrogen gas are introduced continuously during the intermittent supply of oxygen.

Although excess oxidation of the surface of the base material may easily occur when oxygen gas is supplied continuously, when oxygen is supplied intermittently, the oxygen intermittently enters the interior of the base material, excess oxidation of the surface of the base material can be prevented, thickness of the transparent oxide layer formed on the base material surface can be further controlled, and thickening of the transparent oxide film on the base material surface is prevented.

By the hardening method of the present embodiment, thickness of the transparent oxide film can be suppressed to a value less than or equal to 10 nm, discoloration due to interference of light can be avoided, and metallic luster of the surface of the pure titanium or titanium alloy member 10 can be maintained Of course, rather than introducing oxygen gas intermittently, the oxygen gas may be supplied continuously.

Moreover, rather than introducing the oxygen gas after the mixed gas of inert gas and hydrogen gas, the oxygen gas may be introduced simultaneously with the mixed gas of inert gas and hydrogen gas.

For example, in a mixed gas of inert gas, oxygen gas, and hydrogen gas, the total pressure of gas is $9\times10^{-4}$ Pa to $5\times10^{-1}$ Pa, content of oxygen gas at the total pressure is 1,000 ppm to 15,000 ppm, and content of hydrogen at the total pressure is 1,000 ppm to 50,000 ppm.

Then in step S5, the supply of the mixed gas of inert gas and hydrogen gas is stopped so as to remove hydrogen gas having entered the interior of the titanium or titanium alloy base material processed in the aforementioned manner, and while temperature of the vacuum oven is maintained, inert gas is introduced for a period greater than or equal to 30 minutes. For example, the degree of vacuum is set to $1\times10^{-3}$ Pa, to $5\times10^{-1}$ Pa. The introduced inert gas, for example, is argon gas or helium gas. In step S5 (hydrogen removal step), the temperature of the vacuum oven is preferably higher than the temperature of the hardening treatment step (step S4), and for example, is greater than or equal to 700° C.

The introduction of hydrogen in the present embodiment in the aforementioned manner contributes to moderation of the thickness of the surface transparent oxide layer of the titanium, and can increase the diffusion rate of oxygen in the base material. However, hydrogen embrittlement may occur due to formation of impurities, such as hydrides, due to introduction of hydrogen. Thus, after the hardening treatment in the present embodiment, processing (step S5) is performed to remove hydrogen. In the hydrogen removing step S5, inert gas is fed at high temperature, accumulated hydrogen in the interior of the base material is driven out, the hydrogen of the base material interior is removed, the generation of hydrogen compounds is suppressed, and the phenomenon of hydrogen embrittlement is prevented. Moreover, the release of hydrogen from the base material surface has the effects of accelerating the diffusivity of oxygen into the titanium, preventing the high concentration of oxygen in solid solution at the titanium surface, and thinning the transparent oxide film of the base material surface. As a result, thickness of the transparent oxide layer of the base material surface can be kept at a value less than or equal to 10 nm, and discoloration due to interference of light can be prevented.

Next, in step S6, the base material is cooled down to room temperature under an inert gas atmosphere. In order to prevent discoloration due to oxidation of the base material surface, introduction of the inert gas continues during the lowering of temperature.

Change of hardness of the base material with depth in a direction perpendicular to the base material surface was measured for the titanium or titanium alloy member processed by the surface hardening method of the present embodiment (for the specific hardness measurement method, see description relating to Table 1).

Figure 6:
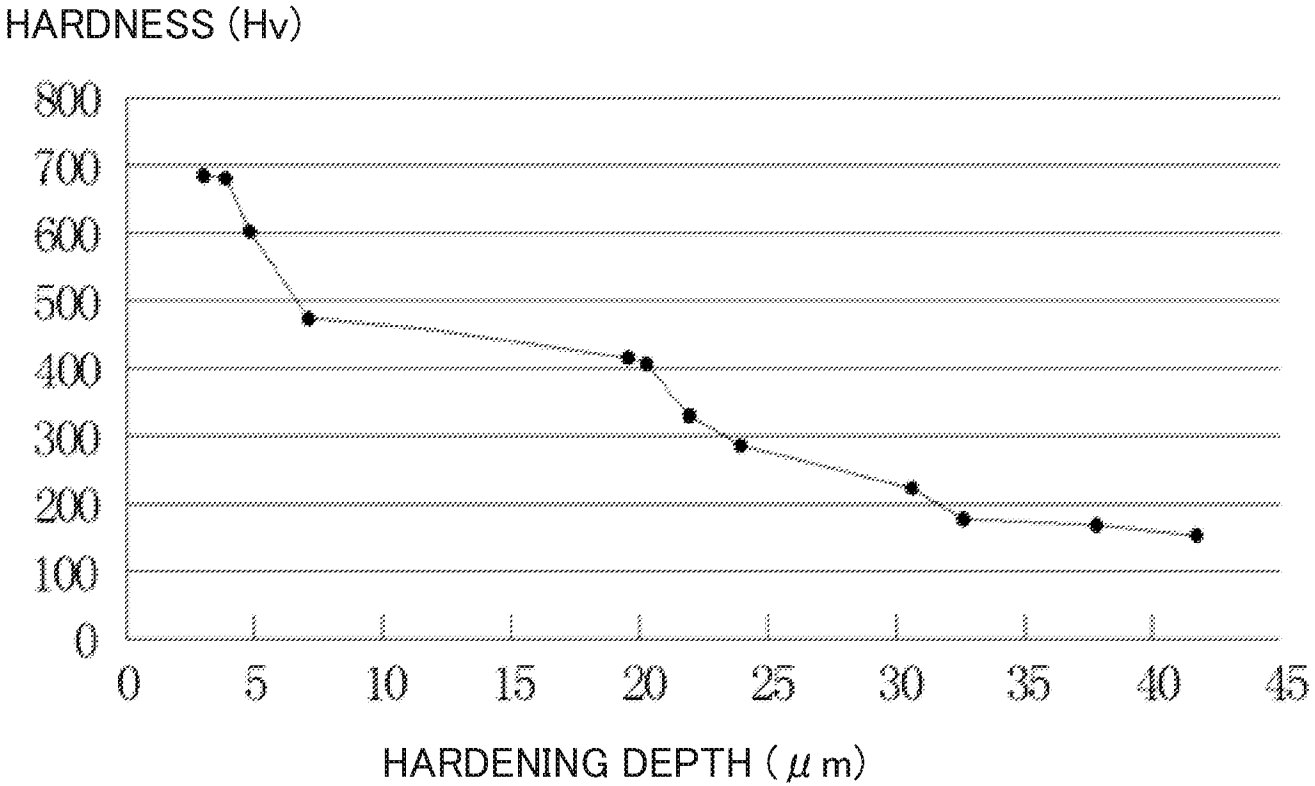
FIG. 6 is a drawing illustrating a relationship between hardening depth and hardness for the titanium or titanium alloy member of Embodiment 2 of the present disclosure.

FIG. 6 is a drawing illustrating a relationship between hardening depth and hardness for the titanium or titanium alloy member in Embodiment 2 of the present disclosure.

As illustrated in FIG. 6, the titanium or titanium alloy member processed by the surface hardening method of the present embodiment has the highest hardness at the surface of the member, hardness reaches 700 Hv, and hardness is sufficiently high for actual use. At locations further into the interior of the pure titanium or titanium alloy member, hardness decreases, and at extremely deep locations, the hardness of the decreases down to a value as low as that of the pure titanium or titanium alloy base material.

Moreover, the external diffusion layer is the portion, below the base material surface, having hardness greater than or equal to 300 Hv, and as illustrated in FIG. 6, having a thickness of about 24 μm. Moreover, the internal diffusion layer is the portion having a hardness less than or equal to 300 Hv, and as illustrated in FIG. 6, is the portion from 24 μm to 32 μm depth, and has a thickness of about 8 μm.

Further, thickness (depth from the surface) of the hardened layer of the titanium or titanium alloy member varies in accordance with the processing period of the hardening treatment step, and this thickness is about 10 to 40 μm.

Although high hardness is obtainable by the conventional surface hardening treatment method, the surface of the base material may become discolored due to oxygen diffusion and solid solution formation at high temperature. Due to interference of light, thickness of the transparent oxide layer of the base material surface greatly affects the color of the base material, and thus when the hardening treatment and the thickness of the transparent oxide layer are not controlled, thickness of the oxide film will vary in accordance with specific conditions, and variance occurs in the external appearance or color of the obtained titanium member. In the present embodiment, sufficiently high hardness is obtained, thickness of the transparent oxide film is controlled at less than or equal to 10 nm, the generation of impurities is suppressed, the surface of the titanium member can maintain bright metallic luster, and the titanium or titanium alloy member is obtained that has good quality by combing high hardness and high metallic luster.

Embodiment 3

Figure 7:
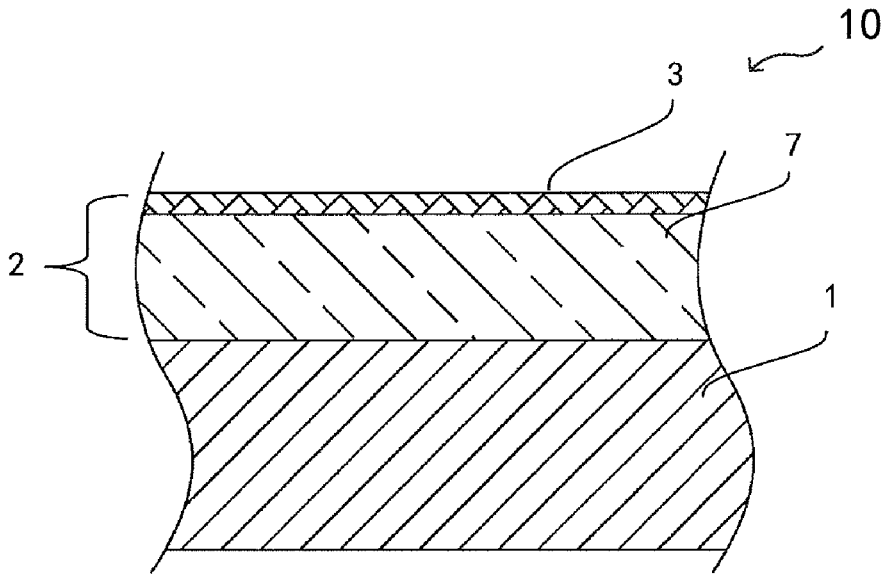
FIG. 7 is a schematic drawing of structure of the titanium or titanium alloy member according to Embodiment 3 of the present disclosure.

FIG. 7 is a schematic drawing of structure of a titanium or titanium alloy member according to Embodiment 3 of the present disclosure.

The pure titanium or titanium alloy member 10 illustrated in FIG. 7 includes the base material 1 formed from pure titanium or titanium alloy, and at the surface of the base material 1, the hardened layer 2 formed by diffusion of oxygen and nitrogen into the surface. The hardened layer 2 includes the surface transparent oxide layer 3 and a diffusion layer 7.

In the present embodiment, thickness of the surface transparent oxide layer 3 is suppressed to a value less than or equal to 10 nm. In the diffusion layer 7, oxygen and nitrogen diffuse into the base material 1 and form a solid solution. Oxygen and nitrogen are α phase stabilizer elements and have high solid solubility in the titanium base material. By dissolved in solid solution in titanium, oxygen and nitrogen cause a remarkable increase in hardness of titanium. Descriptions of points in common with the pure titanium or titanium alloy member illustrated in FIG. 1 are omitted.

Figure 8:
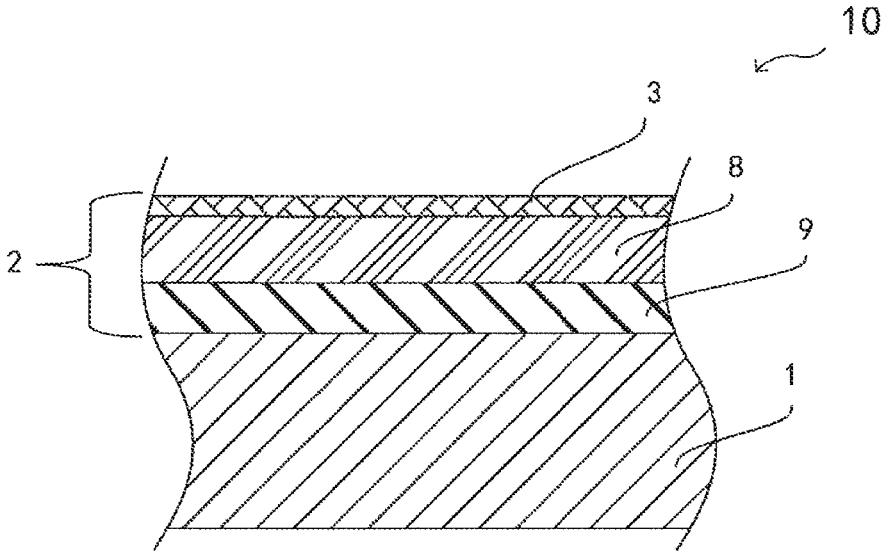
FIG. 8 is a schematic drawing of another structure of the titanium or titanium alloy member according to Embodiment 3 of the present disclosure.

FIG. 8 is a schematic drawing of another structure of the titanium or titanium alloy member according to Embodiment 3 of the present disclosure.

As illustrated in FIG. 8, the pure titanium or titanium alloy member 10 includes the base material 1 formed from pure titanium or titanium alloy, and the hardened layer 2 formed in the surface of the base material 1; and the hardened layer 2 includes the surface transparent oxide layer 3, an external diffusion layer 8, and an internal diffusion layer 9. The external diffusion layer 8 includes, on an inner side of the surface transparent oxide layer 3, a portion having a hardness greater than or equal to 300 Hv, and the internal diffusion layer 9 includes a portion having a hardness less than or equal to 300 Hv. That is to say, in FIG. 8, the diffusion layer includes the external diffusion layer 8 and the internal diffusion layer 9.

In the external diffusion layer 8, oxygen and nitrogen are dissolved in solid solution at high concentrations, and thickness of the external diffusion layer 8 affects the surface hardness of the base material 1. In the internal diffusion layer 9, the concentrations of oxygen and nitrogen dissolved in solid solution gradually decreases from outside towards inside, and hardness also gradually decreases from 300 Hv to about the same as that of the base material 1 of the pure titanium or titanium alloy member 10.

Thickness of the external diffusion layer 8 and the internal diffusion layer 9 is about 10 to 40 μm. Descriptions of points in common with the pure titanium or titanium alloy members illustrated in FIGS. 1 and 4 are omitted.

By formation of the hardened layer 2, the pure titanium or titanium alloy member 10 of the present embodiment, maintains high surface luster and good external appearance while having high hardness.

Embodiment 4

The present embodiment relates to a surface hardening method of the pure titanium or titanium alloy. With the exception of the point of including nitrogen in the hardening process gas, the surface hardening method of the pure titanium or titanium alloy according to the present embodiment is the same as the hardening method of Embodiment 2 illustrated in FIG. 5. Common description is omitted below.

With reference to FIG. 5, in step S2, the titanium or titanium alloy base material is heated to the predetermined temperature while introducing inert gas to the vacuum oven. In the present embodiment, in order to prevent the generation of discoloration due to oxidation of the surface of the base material, the inert gas is supplied continuously during heating. The inert gas, for example, is argon gas or helium gas. Moreover, the predetermined temperature is 600 to 800° C., and preferably is 650 to 750° C.

Next, in step S4, the predetermined temperature is maintained for a fixed period, and a mixed gas of inert gas, such as a mixed gas of argon gas and hydrogen gas, is introduced to the vacuum oven; and after a predetermined period, oxygen gas and nitrogen gas as hardening treatment gases are introduced, and hardening treatment is performed for at least 60 minutes.

In the present embodiment the oxygen gas and the nitrogen gas may be repeatedly introduced. That is to say, after introduction of the oxygen gas and nitrogen gas and passage of the fixed period, the supply of the oxygen gas and nitrogen gas is stopped, and after passage for a further fixed period, the oxygen gas and nitrogen gas are again introduced. The supply of the oxygen gas and nitrogen gas is repeatedly performed in this manner During the repeated supply of the oxygen gas and nitrogen gas, the introduction of the inert gas and hydrogen gas is continued.

Due to the repeated supply of the oxygen gas and nitrogen gas, excessive oxidation of the base material surface can be prevented, and furthermore, thickness of the transparent oxide layer formed on the base material surface can be suppressed. Due to the hardening method of the present embodiment, thickness of the transparent oxide film is suppressed to a value less than or equal to 10 nm, discoloration due to interference of light is avoided, and metallic luster of the surface of the titanium or titanium alloy member can be maintained Of course, rather than introducing oxygen gas and nitrogen gas repeatedly, the oxygen gas and nitrogen gas may be supplied continuously. Moreover, rather than introducing the oxygen gas and nitrogen gas after the mixed gas of inert gas and hydrogen gas, the oxygen gas and nitrogen gas may be introduced simultaneously with the mixed gas of inert gas and hydrogen gas.

The titanium or titanium alloy member processed by the surface hardening method of the present embodiment has a depth (depth from the surface) of the hardened layer of the titanium or titanium alloy member that varies in accordance with the processing period of the hardening treatment step, and this depth is 10 to 40 μm. Moreover, hardness of the hardened layer reaches 200 to 700 Hv.

In the present embodiment, in addition to obtaining high hardness, thickness of the transparent oxide film is controlled at less than or equal to 10 nm, the generation of impurities is suppressed, the surface of the titanium member can maintain metallic luster, and the titanium or titanium alloy member can be obtained that has high quality that combines high hardness and high metallic luster.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Chinese Patent Application No. 201710000671.1, filed on Jan. 3, 2017, and Chinese Patent Application No. 201711284040.3, filed on Dec. 7, 2017, the entire disclosures of which are incorporated herein by reference.

REFERENCE SIGNS LIST

1 Base material
2 Hardened layer
3 Surface transparent oxide layer
4 Diffusion layer
5 External diffusion layer
6 Internal diffusion layer
10 Pure titanium or titanium alloy member

The invention claimed is:

1. An alloy member comprising:
a base material of titanium or titanium alloy; and
at a surface of the base material, a hardened layer formed by diffusion of oxygen into the surface,
wherein the hardened layer includes (i) a surface transparent oxide layer, and (ii) a diffusion layer disposed internally from the surface transparent oxide layer.

2. The alloy member according to claim 1, wherein the diffusion layer is thicker than the surface transparent oxide layer.

3. An alloy member comprising:
a base material of titanium or titanium alloy; and
at a surface of the base material, a hardened layer formed by diffusion of oxygen into the surface,
wherein:
the hardened layer includes, in order inwardly from the surface of the base material, a surface transparent oxide layer, an external diffusion layer, and an internal diffusion layer,
the external diffusion layer includes a portion having a hardness greater than or equal to 300 Hv, the portion being disposed internally from the surface transparent oxide layer, and
the internal diffusion layer includes a portion having a hardness less than 300 Hv.

4. The alloy member according to claim 3, wherein:
a concentration of oxygen dissolved in solid solution in the external diffusion layer is higher than that in the internal diffusion layer, and
the concentration of oxygen dissolved in solid solution in the internal diffusion layer gradually decreases from outside towards inside.

5. The alloy member according to claim 3, wherein:
concentrations of oxygen and nitrogen dissolved in solid solution in the external diffusion layer are higher than those in the internal diffusion layer, and
the concentrations of oxygen and nitrogen dissolved in solid solution in the internal diffusion layer gradually decrease from outside towards inside.

6. The alloy member according to claim 3, wherein the surface transparent oxide layer is thinner than the external diffusion layer and the internal diffusion layer.

7. The alloy member according to claim 6, wherein:
a concentration of oxygen dissolved in solid solution in the external diffusion layer is higher than that in the internal diffusion layer, and the concentration of oxygen dissolved in solid solution in the internal diffusion layer gradually decreases from outside towards inside.

8. The alloy member according to claim 1, wherein the titanium or titanium alloy member is applicable to a casing component of a wristwatch or a clock.

9. The alloy member according to claim 8, wherein the casing component includes a bezel, a bezel center region, a back cover, or a band.

* * * * *